United States Patent [19]

Lucas et al.

[11] Patent Number: 4,880,225

[45] Date of Patent: Nov. 14, 1989

[54] DUAL ACTION CYCLE EXERCISER

[75] Inventors: James F. Lucas, Auburn; Bruce F. Coody, Opelika, both of Ala.

[73] Assignee: Diversified Products Corporation, Opelika, Ala.

[21] Appl. No.: 225,176

[22] Filed: Jul. 28, 1988

[51] Int. Cl.[4] ..... A63B 21/00

[52] U.S. Cl. ..... 272/73

[58] Field of Search ..... 272/73, 130, 71, 72, 272/131, 132; 128/25 R

[56] References Cited

U.S. PATENT DOCUMENTS

| | | | |
|---|---|---|---|
| 326,247 | 9/1885 | Root . | |
| 2,032,303 | 12/1934 | Orgitano . | |
| 2,261,355 | 11/1941 | Flynn . | |
| 2,453,771 | 11/1948 | White . | |
| 2,565,348 | 8/1951 | Brockman . | |
| 2,603,486 | 7/1952 | Hughes . | |
| 2,825,563 | 3/1958 | Lawton . | |
| 2,872,191 | 2/1959 | Gallo . | |
| 3,112,108 | 11/1963 | Hanke . | |
| 3,758,111 | 9/1973 | Agamian . | |
| 3,940,128 | 2/1976 | Ragone . | |
| 4,188,030 | 2/1980 | Hooper | 272/73 |
| 4,509,742 | 4/1985 | Cones | 272/73 |
| 4,712,790 | 12/1987 | Szymski | 272/73 |
| 4,741,527 | 5/1988 | Nestegard | 272/73 |
| 4,757,988 | 7/1988 | Szymski . | |

FOREIGN PATENT DOCUMENTS

| | | |
|---|---|---|
| 994823 | 8/1976 | Canada . |
| 517774 | 2/1931 | Fed. Rep. of Germany . |
| 1194046 | 6/1970 | United Kingdom . |

OTHER PUBLICATIONS

Schwinn Fitness Catalog (1987).
Sears Advertisement, "Lifestyler Tailwing" (1989).
Panasonic, "Bicycles" (date unknown).
Vitamaster Catalog (circa 1979).
Defendant's Exhibit 105.
Plaintiff's Exhibit 24A.

*Primary Examiner*—Stephen R. Crow
*Attorney, Agent, or Firm*—Banner, Birch, Mc Kie & Beckett

[57] ABSTRACT

A dual action cycle exerciser providing for exercising movement of the arms and legs using rotating pedals and oscillating handlebar levers. Connecting rods linking the handlebar levers and the pedals are journalled about the pedal axes via upwardly projecting rigid portions, resulting in a simplified construction affording beneficial exercise results, improved access to the seat of the cycle exerciser, and easier initiation of exercise movement.

3 Claims, 3 Drawing Sheets

DUAL ACTION CYCLE EXERCISER

BACKGROUND

This invention relates to cycle exercisers and, in particular, to a cycle exerciser of the dual action type wherein oscillating handlebar levers provide exercise for the muscle groups of the upper body.

U.S. Pat. No. 4,188,030 to Hooper, incorporated herein by reference, discloses a cycle exerciser of the aforementioned type. In this device, the rotary movement of the foot pedals and the oscillating movement of the handlebar levers are timed "so as to achieve a natural balance between upper and lower body movements in a manner similar to walking and running." This is achieved through the use of a rather complex eccentric drive mechanism for the handlebar levers. In one embodiment, an eccentric cam disc rotates with the pedal cranks, and a cam follower having a plurality of rollers embraces the cam disc. In another embodiment, a dual crank arrangement is provided on the main drive shaft, one pair of cranks for the foot pedals and the other pair of cranks for the handlebar levers. In each of these embodiments, the drive for the handlebar levers is about 90° out of phase with the pedal cranks, resulting in the coordinated motion quoted above. Resistance to exercising movement is provided by a vaned wheel driven through sprockets and chains off the main drive shaft.

Several drawbacks are inherent in the design of a product constructed in accordance with the Hooper patent. Due in large part to its complex construction, as described above, manufacturing cost naturally is a concern. In addition, FIG. 5 of the Hooper patent reveals, and experience with a commercial device of the Hooper design confirms, that one inherent feature of the Hooper design may be troublesome to some users. That is, with the foot pedals in the 12 and 6 o'clock positions, one of the handlebar levers resides close to or at its rearmost position, in close proximity to the seat. For users that are accustomed to mounting and dismounting the exerciser by standing on the lower of the two pedals, the proximity of the rearmost handlebar lever to the seat can cause interference during either of these maneuvers. Further, the 12 and 6 o'clock positions of the foot pedals are, respectively, the top and bottom dead center positions of the pedal cranks. In these positions, it is difficult to initiate rotation of the drive shaft by a downward thrust on one of the pedals. A push or a pull on the handlebar levers similarly will not easily initiate rotation of the drive shaft because the eccentrics or cranks for the handlebar levers also are at their dead center positions. Initiation of exercise therefore requires an awkward bend of the foot to push the top pedal forward, or hooking the top pedal from behind with the top of the foot.

SUMMARY OF THE INVENTION

It is, therefore, an object of the present to provide a dual action cycle exerciser of the type described which is simpler in construction and therefore more reliable and less costly to manufacture than those presently available, while providing a natural and comfortable body movement and beneficial exercise.

A further object of the invention is to provide such a cycle exerciser which provides ample clearance between handlebar levers and seat when the pedal cranks are in their vertical positions, thereby facilitating mounting and dismounting maneuvers, and initiation of exercise movement.

In accordance with the present invention, a simplification of the prior art drive mechanism for the oscillating handlebar levers has resulted in a change in geometry whereby greater clearance exists between the handlebar levers and the seat with the pedal cranks in their vertical positions than heretofore achieved by the prior art. This has led to an alteration of the dynamics involved but, surprisingly, the arm and leg movements on the modified device according to the invention feel quite natural. Specifically, it is noted that the timing of the arm and leg movements in the cycle exerciser according to the invention apparently is somewhat different from the natural movements encountered during walking. However, contrary to the teachings implied in Hooper, it appears that coordinated skeletal and muscular dynamics for a seated cycling and arm pumping exercise need not closely approximate the dynamics involved in walking. Thus, the dynamic movements resulting from the use of applicants' inventive cycle exerciser unexpectedly yield a quite natural feed and appear to provide the desired beneficial exercise results. In addition, the dead center positions of the pedals and the handlebar levers never coincide, thereby facilitating initiation of exercise movement. Asymmetrical push and pull forces on the handlebar levers also result from this construction, yielding enhanced exercise benefits.

The cycle exerciser of the present invention comprises a frame; energy absorbing means including a resistance wheel rotatably mounted on the frame; drive means for rotating the wheel and a seat mounted on the frame. The drive means includes a transverse drive shaft journalled on the frame and offset from the wheel axis; transmission means interconnecting the drive shaft and the wheel; a pair of cranks respectively secured to opposite ends of the drive shaft so as to rotate therewith; two foot pedals attached to respective cranks 180° out of phase and rotatable on the outboard sides of the cranks about respective transverse pedal axes; a pair of oscillating handlebar levers, with handles at their upper ends, pivotally mounted on the frame intermediate their ends ahead of the drive shaft for fore and aft movement on opposite sides of the frame; and a pair of connecting rods at opposite sides of the frame, each connecting rod pivoted to a lower portion of the respective handlebar lever, and pivoted to the respective crank about the respective pedal axis, whereby oscillation of the handlebar levers causes rotation of the cranks and the driveshaft, and vice versa and rotation of the wheel. The seat is mounted above and aft of the drive shaft to position a user within reach of the foot pedals and the handles. The connecting rods have rigidly attached upwardly projecting portions that link them to the cranks and maintain the connecting rods below the pedals so the user's feet cannot be pinched.

Additional features and advantages of the present invention will become apparent from a consideration of the following detailed description taken in conjunction with the accompanying drawings.

DETAILED DESCRIPTION

Figure 1:
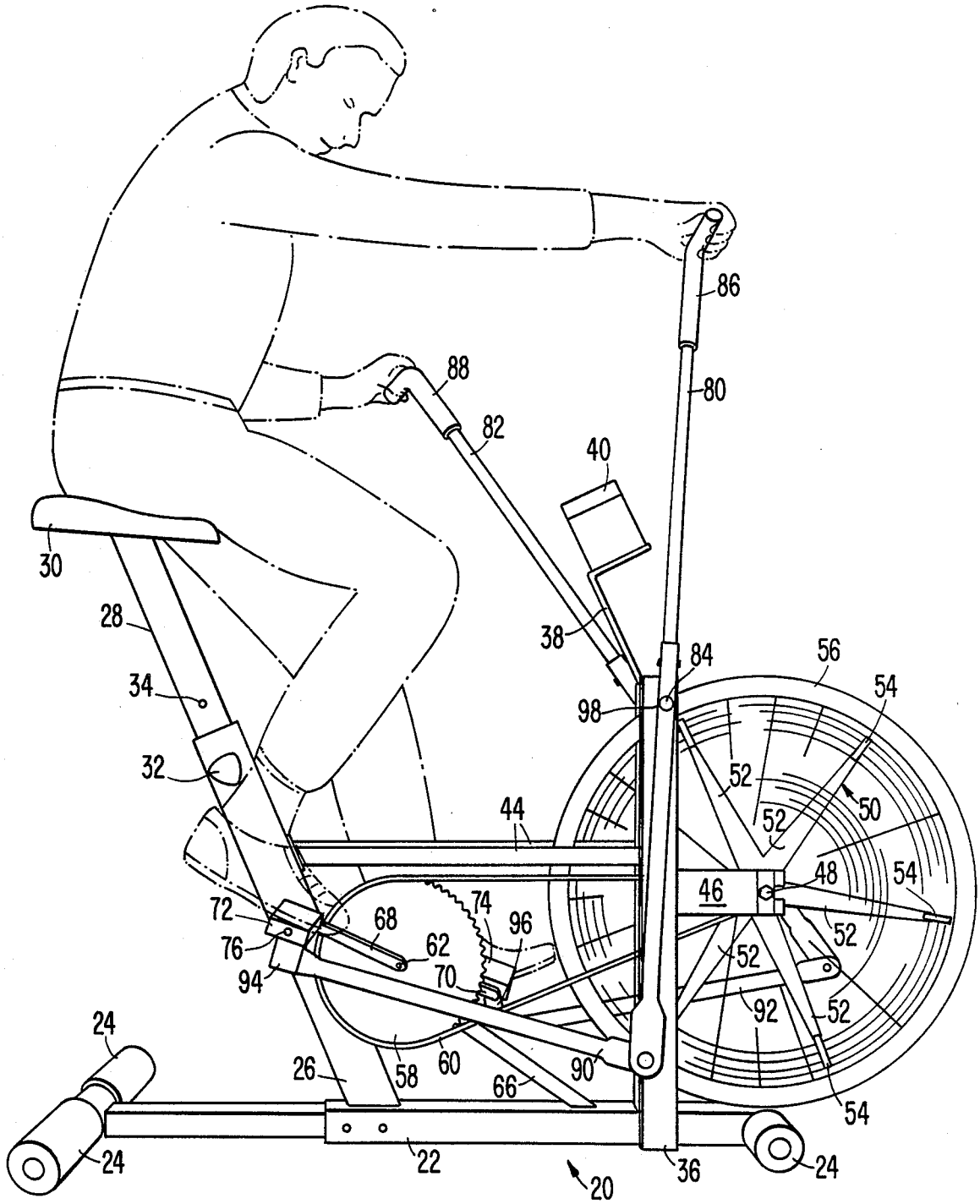
FIG. 1 is a perspective view of a cycle exerciser according to the invention.

Referring to the figures, the cycle exerciser comprises a frame 20 composed largely of steel tubing having a longitudinal base member 22 supported on plastic-clad transverse feet 24. A hollow seat support member 26 extends obliquely upwardly and rearwardly from base member 22 and telescopingly receives a seat post 28 on which is mounted a seat 30. A threaded locking knob 32 engages any one of a number of longitudinally spaced holes 34 in seat post 28 for selectively adjusting the height of seat 30.

A pair of upstanding posts 36 are secured to base member 22 near the front of the frame. Posts 36 are interconnected at their upper ends by a bracket 38 that also serves as a support for a speedometer unit or other metering device 40. Longitudinal struts 44 interconnect each of the posts 36 with the seat support member 26, thus completing a rigid frame for supporting the user and the various working components.

A slotted plate 46 projects forwardly from each post 36 and rotatably receives the ends of an axle 48 on which a vaned wheel assembly 50 rotates. Vaned wheel assembly 50 is the energy absorbing means that provides resistance to movement of the user's arms and legs. Vaned wheel assembly 50 comprises several radial spokes 52 secured to a hub (not shown) that spins with axle 48. Flat, transverse, paddle-like vanes 54 are mounted around the periphery of wheel assembly 50. Resistance to rotation of vaned wheel assembly 50 is afforded by the air resistance encountered by vanes 54: the faster vaned wheel assembly 50 rotates, the greater the air resistance. The entire vaned wheel assembly 50 is housed within a molded plastic fan shroud 56 that is suitably attached to frame 20.

Rotation of vaned wheel assembly 50 is effected through a transmission comprising a large sprocket 58 driving a chain 60, which drives a much smaller sprocket (not shown) mounted on axle 48 and fixed to the hub of vaned wheel assembly 50 to rotate therewith. The large reduction ratio occasioned by the relative sizes of the two sprockets causes vaned wheel assembly 50 to rotate at a comparatively high rate of speed.

Sprocket 58 is affixed to a transverse drive shaft 62 that is journalled in bearing housing 64. Bearing housing 64 is mounted on an oblique strut 66 spanning base member 22 and seat support member 26. Pedal cranks in the form of crank arms 68, 70 are secured to the opposite ends of drive shaft 62, 180° out of phase. These crankarms respectively carry foot pedals 72, 74 that are respectively journalled about pedal axes 76, 78. Crank arms 68, 70 represent only one form of crank that may be used on drive shaft 62. Other forms of cranks, such as a one-piece, forged crank assembly or solid discs, would be suitable alternatives.

Handlebar levers 80, 82 are pivotally mounted near the upper ends of posts 36, above drive shaft 62, along a common axis 84 for fore and aft oscillating movement on opposite sides of the frame. The upper ends of handlebar levers 80, 82 are provided with handles 86, 88, while the lower ends are pivotally attached to connecting rods 90, 92. The rear ends of the connecting rods carry upstanding rigid tabs 94, 96, and these tabs are respectively journalled to crank arms 68, 70 and pedals 72, 74 about pedal axes 76, 78. Upstanding tabs 94, 96 perform an important safety-related function, although they are not an essential part of the basic invention. These tabs serve to maintain the connecting rods in the vicinity of pedals 72, 74 sufficiently below the level of the pedals, no matter what their positions, so that the user's feet will not be caught by the connecting rods. Fixed footrests 98, 100 are provided in alignment with axis 84.

Figure 2:
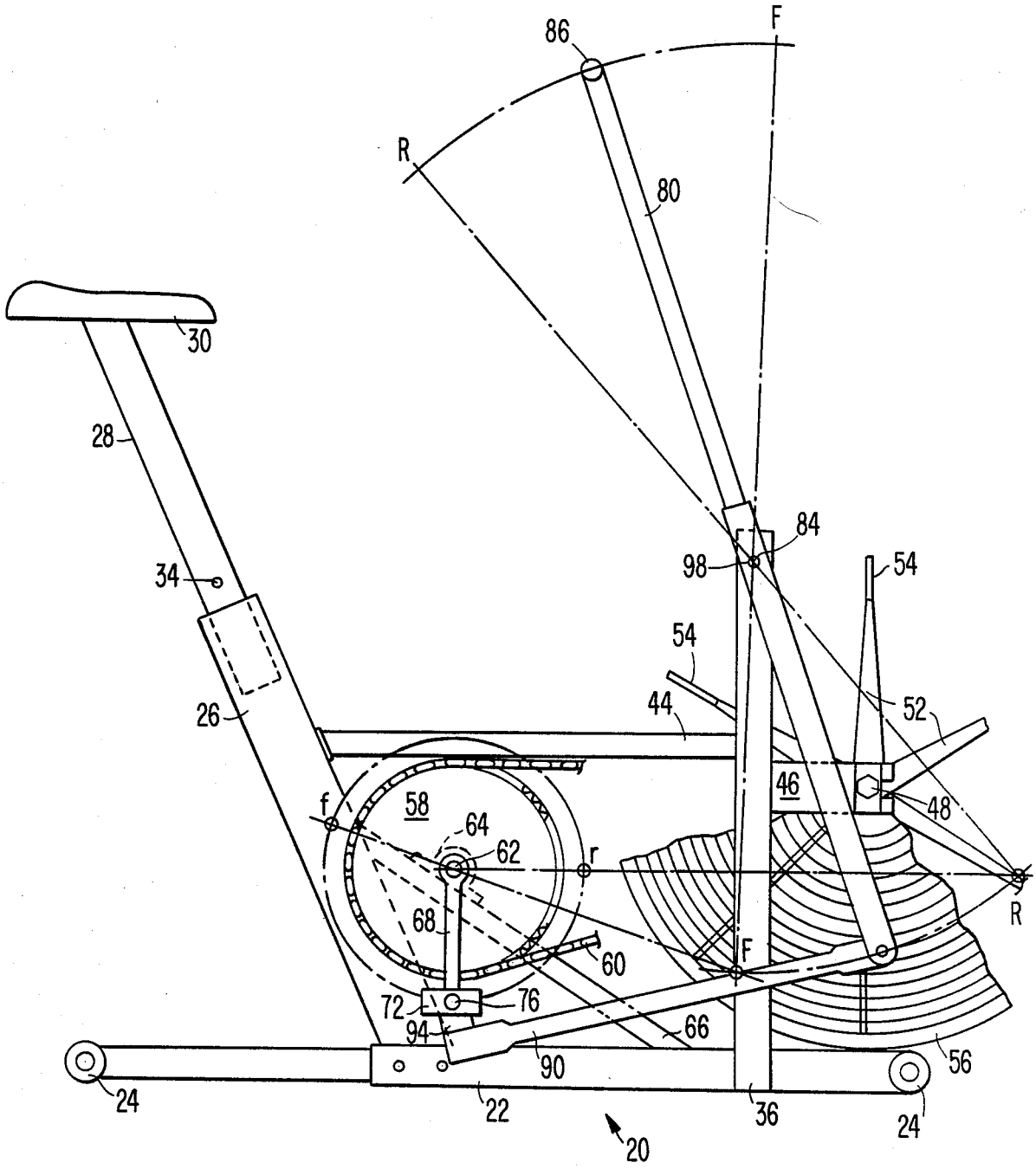
FIG. 2 is a side elevational view of the cycle exerciser of FIG. 1, with portions broken away for simplicity to illustrate the geometry and dynamics involved.
Figure 4:
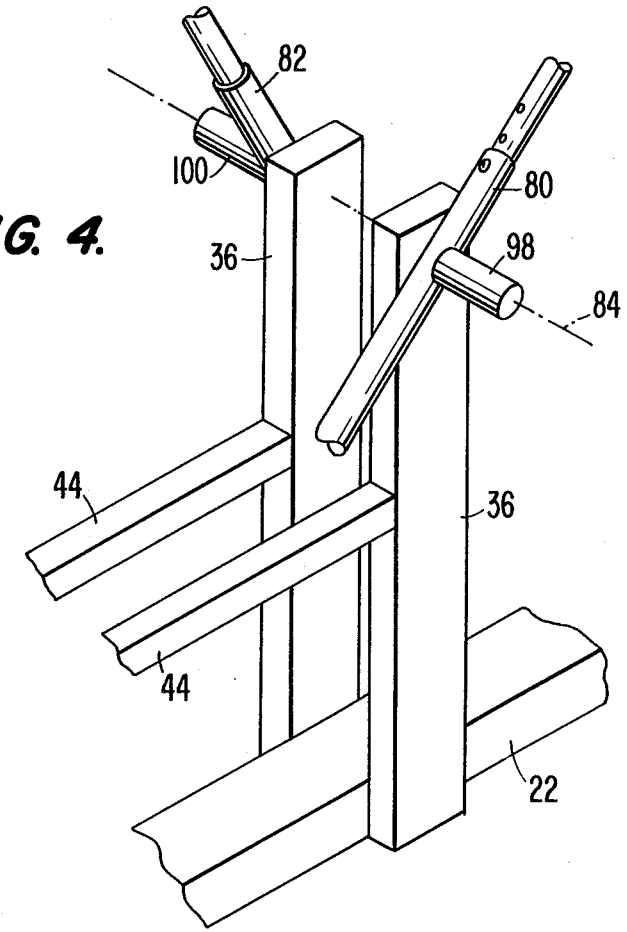
FIG. 4 is a partial perspective view showing certain details of the cycle exerciser.
Figure 3:
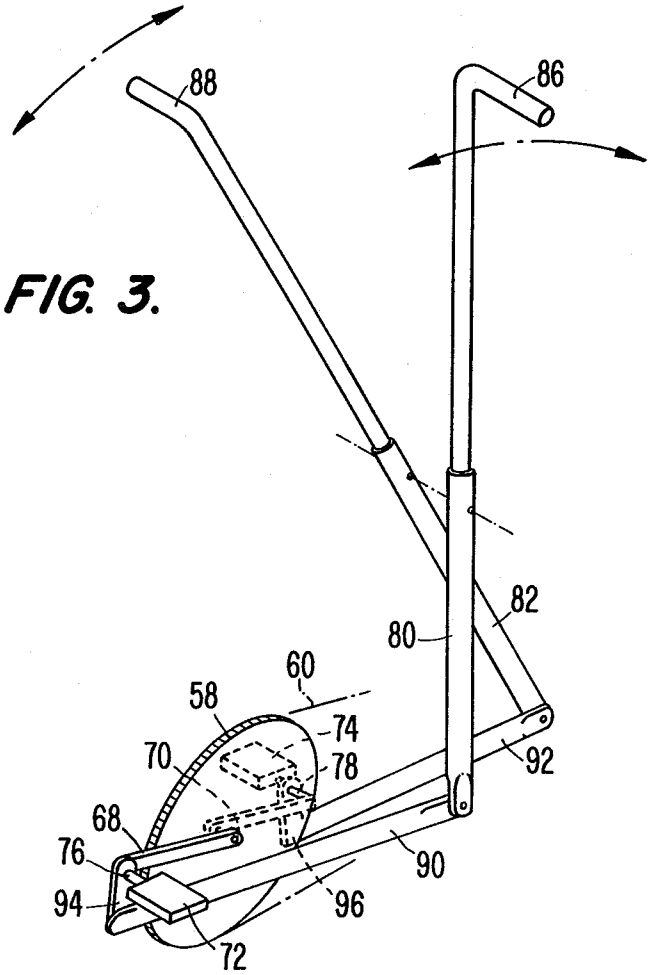
FIG. 3 is a perspective schematic view of the operational parts of the cycle exerciser.

In operation, a user seated on seat 30 may engage in exercise and rotate vaned wheel assembly 50 by pedalling with his legs on pedals 72, 74, by oscillating handlebar levers 80, 82 (with his feet braced on footrests 98, 100), or by doing both. The unique design of the cycle exerciser according to the invention provides some useful advantages. Because the connecting rods 90, 92 are pivoted about the pedal axes 76, 78, handles 86, 88 are located substantially forward of their rearmost positions when either pedal 72, 74 is in its lowest (i.e., bottom dead center) position (i.e., when pedal crank arms 68, 70 are substantially vertical). This is best illustrated in FIG. 2, which shows right pedal 72 in its bottom dead center position (left pedal 74, not shown, would be in its top dead center position). Corresponding right handlebar lever 80 is in an intermediate position as shown by the solid lines, with handle 86 well forward of its rearmost position, indicated by the phantom line R—R and corresponding to right pedal position r. The other (left) handle 88 (not shown in FIG. 2) will be located slightly forward of handle 86. The forwardmost position of right handle 86 is indicated by the phantom line F—F, which corresponds to right pedal position f. Thus, substantial clearance is provided between the handles 86, 88 and seat 30 so that access to seat 30 is unhindered by handles 86, 88. This is especially helpful to many users who choose to stand on one pedal during mounting or dismounting maneuvers. In addition, the dead center positions of foot pedals 72, 74 never coincide with the dead center positions (f,F and r,R) of handlebar levers 80, 82, making initiation of exercise movement a simple matter.

Although this handlebar lever drive arrangement somewhat alters the arm and leg coordination referred to in the Hooper patent, it has been found that the leg and arm movements afforded by the present invention feel quite natural and appear to provide the desired beneficial exercise. In addition, the push and pull forces on the handlebar levers are asymmetrical, resulting in enhanced exercise benefits. That is, depending on the direction of rotation of the pedals, the push forces on the handlebar levers will exceed the pull forces, or vice versa. This is due to the fact that the dead center positions f,r of the handlebar levers are not 180° apart relative to drive shaft 62. The major upper body muscle groups utilized in the push mode are the triceps, interior deitoids and pectorals. The major upper body muscle groups utilized in the pull mode are the biceps, lats and trapezius. Rarely does an individual possess equal strength in these opposing exercise movements. It is, therefore, an advantage to be able to exercise at pull forces exceeding push forces, or vice versa. The dual action mechanism of the invention allows the user to select either mode by pedaling either forward or backward.

Compared to the embodiment of FIG. 7 of the Hooper patent, which uses rather short handlebar lever cranks 44 linked by the connecting rods to rather short lever lower sections 29 of the handlebar levers beneath their pivots, the dual action cycle exerciser of the invention uses relatively long drive cranks (i.e., pedal cranks 68, 70) and relatively long lower handlebar lever sections (those that project below pivot axis 84). This results in less force being transmitted through connecting rods 90, 92, and less stress on the pivots at the ends of the connecting rods. Lighter duty (and therefore less costly) components therefore can be used, and component life can be prolonged.

While a preferred embodiment of the invention has been shown and described in detail, it will be readily understood and appreciated by those skilled in the art that numerous omissions, changes and additions may be made without departing from the spirit and scope of the present invention, which is limited only by the appended claims.

We claim:

1. A cycle exerciser comprising:

a frame;

a transverse drive shaft journalled on said frame;

a pair of cranks respectively secured 180 degrees out of phase to opposite ends of said drive shaft so as to rotate therewith;

a foot pedal attached to the outboard side of each of said cranks and rotatable thereon about a transverse pedal axis;

a pair of oscillating handlebar levers pivotally mounted on said frame intermediate their ends ahead of said drive shaft for fore and aft movement on opposite sides of said frame;

a handle at the upper end of each of said handlebar levers;

a seat mounted on said frame above and aft of said drive shaft to position a user within reach of said foot pedals and said handles;

a pair of connecting rods at opposite sides of said frame, each connecting rod pivoted at its forward end to the lower end of the respective handlebar lever, and having at its rear end a rigidly attached upwardly projecting portion which is pivoted to the respective crank about the respective pedal axis, whereby rotation of said pedals and oscillation of said handlebar levers are synchronized and said connecting rods are located below said pedals throughout their revolution about said drive shaft; and energy absorbing means on said frame operatively connected to said drive shaft for resisting rotation of said drive shaft caused by the user's rotation of said pedals and/or oscillation of said handlebar levers.

2. A cycle exerciser according to claim 1 wherein each of said upwardly projecting portions is interposed between the respective crank and pedal.

3. A cycle exerciser according to claim 1 wherein both of said handles are located substantially forward of their rearmost positions of travel when either of said pedals is substantially in its lowest position, thereby affording substantially unhindered access to said seat when said handles are so positioned.

* * * * *